US009834022B2

(12) United States Patent
Morita

(10) Patent No.: US 9,834,022 B2
(45) Date of Patent: Dec. 5, 2017

(54) THERMAL RECORDING MATERIAL

(71) Applicant: MITSUBISHI PAPER MILLS LIMITED, Sumida-ku, Tokyo (JP)

(72) Inventor: Kunio Morita, Sumida-ku (JP)

(73) Assignee: MITSUBISHI PAPER MILLS LIMITED, Sumida-ku, Tokyo (JP)

( * ) Notice: Subject to any disclaimer, the term of this patent is extended or adjusted under 35 U.S.C. 154(b) by 0 days.

(21) Appl. No.: 15/109,678

(22) PCT Filed: Jan. 16, 2015

(86) PCT No.: PCT/JP2015/051093
§ 371 (c)(1),
(2) Date: Jul. 5, 2016

(87) PCT Pub. No.: WO2015/111518
PCT Pub. Date: Jul. 30, 2015

(65) Prior Publication Data

US 2016/0332469 A1 Nov. 17, 2016

(30) Foreign Application Priority Data

Jan. 27, 2014 (JP) ..... 2014-012517

(51) Int. Cl.
*B41M 5/333* (2006.01)
*B41M 5/41* (2006.01)
*B41M 5/30* (2006.01)

(52) U.S. Cl.
CPC ..... *B41M 5/3333* (2013.01); *B41M 5/30* (2013.01); *B41M 5/41* (2013.01); *B41M 2205/04* (2013.01)

(58) Field of Classification Search
CPC ..... B41M 5/333; B41M 5/3333; B41M 5/40; B41M 5/41; B41M 2205/04
USPC ..... 503/200, 216
See application file for complete search history.

(56) References Cited

U.S. PATENT DOCUMENTS

| | | | |
|---|---|---|---|
| 6,190,781 | B1 | 2/2001 | Tsubaki et al. |
| 2002/0094933 | A1 | 7/2002 | Iwasaki et al. |
| 2008/0103041 | A1 | 5/2008 | Iida et al. |
| 2010/0084102 | A1 | 4/2010 | Sakai et al. |
| 2010/0105941 | A1 | 4/2010 | Kabashima et al. |
| 2015/0367663 | A1 | 12/2015 | Yamane et al. |
| 2016/0082760 | A1 | 3/2016 | Takano et al. |

FOREIGN PATENT DOCUMENTS

| | | |
|---|---|---|
| CN | 101056769 | 10/2007 |
| CN | 101611196 | 12/2009 |
| JP | 05-262031 | 10/1993 |
| JP | 06-210952 | 8/1994 |
| JP | 07-068932 | 3/1995 |
| JP | 07-195832 | 8/1995 |
| JP | 11-092448 | 4/1999 |
| JP | 11-268421 | 10/1999 |
| JP | 11-271927 | 10/1999 |
| JP | 2000-143611 | 5/2000 |
| JP | 2001-341433 | 12/2001 |
| JP | 2002-160459 | 6/2002 |
| JP | 2002-160461 | 6/2002 |
| JP | 2002-160462 | 6/2002 |
| JP | 2003-291542 | 10/2003 |
| JP | 2012-200937 | 10/2012 |
| WO | 2000/035679 | 6/2000 |
| WO | 2014/126018 | 8/2014 |
| WO | 2014/189044 | 11/2014 |

*Primary Examiner* — Bruce H Hess
(74) *Attorney, Agent, or Firm* — Fitzpatrick Cella Harper and Scinto

(57) ABSTRACT

An object of the present invention is to provide a thermal recording material which is excellent in all of the following characteristics: plasticizer resistance, image stability against moisture and heat, the resistance to background fogging under moisture and heat, and the retention of color developing ability. Provided is a thermal recording material having, on a paper support, a heat-sensitive recording layer containing a colorless or light-colored dye precursor and a developer which reacts with the dye precursor on heating and converts the dye precursor to its colored form, the paper support containing 0.25 to 1.0% by mass of a neutral rosin sizing agent relative to the pulp solid content in combination with calcium carbonate and aluminum sulfate, the developer having a phenylureido moiety in its molecule.

13 Claims, No Drawings

THERMAL RECORDING MATERIAL

This application is a National Phase of PCT Application No. PCT/JP2015/051093 filed Jan. 16, 2015, which in turn claims benefit of Japanese Application No. 2014-012517 filed Jan. 27, 2014.

TECHNICAL FIELD

The present invention relates to a thermal recording material which is excellent in plasticizer resistance, image stability against moisture and heat, the resistance to background fogging under moisture and heat, the retention of color developing ability, etc.

BACKGROUND ART

Generally, thermal recording materials have, on a support, a heat-sensitive recording layer containing an electron-donating dye precursor (hereinafter referred to as a dye precursor) and an electron-accepting developer (hereinafter referred to as a developer). By application of heat to such thermal recording materials with a thermal print head, a thermal stylus, laser beam, etc., an instant reaction between the dye precursor and the developer occurs and thereby a recorded image is produced thereon. Such thermal recording materials have several advantages, for example, that recorded images are produced thereon with a relatively simple device ensuring easy maintenance and no noise generation, and therefore are widely used for measuring recorders, facsimiles, printers, computer terminals, label printers, ticket machines for passenger tickets or other tickets, and the like. Particularly in recent years, thermal recording materials are used as financial record slips such as receipts of gas, water, electricity and other bill payments, account statements issued from ATMs at financial institutions and various receipts, thermal recording labels or tags for point of sales (POS) system, etc. Thus, the application of thermal recording materials is rapidly expanding.

However, thermal recording materials used for the above-mentioned purposes have a problem. That is, when an image area printed on a thermal recording material comes into contact with plastics such as polyvinyl chloride, a plasticizer or other additives contained in the plastics will permeate the image area, which results in the reduction of the image density to an unreadable level. Therefore, there is a demand for thermal recording materials which are excellent in the stability of an image area against plasticizers (hereinafter referred to as plasticizer resistance). Moreover, recording devices used for the above-mentioned purposes are recently used in severer conditions, and accordingly, there is a strong demand for thermal recording materials which are excellent in the stability of an image area against hot and humid conditions after printing (hereinafter referred to as image stability against moisture and heat), in the stability of a non-image area (background area) against hot and humid conditions (hereinafter referred to as resistance to background fogging under moisture and heat), and in color developing ability at the time of printing after long-term storage (hereinafter referred to as retention of color developing ability), in particular, in the retention of color developing ability under hot and humid conditions.

Known thermal recording materials which are excellent in plasticizer resistance include, for example, thermal recording materials of Patent Literature 1 to 6, in which specific compounds having a phenylureido moiety in the molecule are used as a developer. These thermal recording materials are excellent in plasticizer resistance and image stability against moisture and heat, but are unsatisfactory in terms of the resistance to background fogging under moisture and heat. A known method for the improvement of the resistance to background fogging under moisture and heat is the use of acid-free paper as a paper support, but this method deteriorates the retention of color developing ability, in particular, the retention of color developing ability under hot and humid conditions. This is because the use of acid-free paper causes a developer having a phenylureido moiety in its molecule in the heat-sensitive recording layer to easily dissolve under hot and humid conditions and to spread into the paper support.

A thermal recording material having a waterproof heat-sensitive recording layer is described in, for example, Patent Literature 7, in which the waterproofing is achieved by the use of a hydrophobic resin emulsion in the heat-sensitive recording layer. However, this thermal recording material is inadequate in terms of the resistance to background fogging under moisture and heat, and unsatisfactory in terms of retention of color developing ability, in particular, the retention of color developing ability under hot and humid conditions.

Known methods for the improvement of the retention of color developing ability include a method using a high-melting-point alkyl ketene dimer as a sizing agent in the paper support, which is described in, for example, Patent Literature 8. However, alkyl ketene dimers, alkenyl succinic anhydrides, etc. may adversely affect the retention of color developing ability under hot and humid conditions, and there is a need for further improvement of such a method.

CITATION LIST

Patent Literature

Patent Literature 1: JP-A 2000-143611
Patent Literature 2: WO 00/35679
Patent Literature 3: JP-A 2002-160459
Patent Literature 4: JP-A 2002-160461
Patent Literature 5: JP-A 2002-160462
Patent Literature 6: JP-A 2003-291542
Patent literature 7: JP-A 2001-341433
Patent literature 8: JP-A 7-68932

SUMMARY OF INVENTION

Technical Problem

An object of the present invention is to provide a thermal recording material which is excellent in all of the following characteristics: plasticizer resistance, image stability against moisture and heat, the resistance to background fogging under moisture and heat, and the retention of color developing ability.

Solution to Problem

The above-mentioned object can basically be achieved by a thermal recording material having, on a paper support, a heat-sensitive recording layer containing a colorless or light-colored dye precursor and a developer which reacts with the dye precursor on heating and converts the dye precursor to its colored form, the paper support containing 0.25 to 1.0% by mass of a neutral rosin sizing agent relative to the pulp solid content in combination with calcium carbonate and aluminum sulfate, the developer having a phenylureido moiety in its molecule.

The phenylureido moiety is preferably a moiety represented by the following general formula (1).

General formula (1)

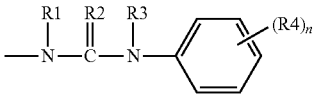

In the formula, R1 and R3 are hydrogen atoms, R2 is an oxygen atom, R4 is selected from a hydrogen atom and a group that can be a substituent on the benzene ring, and n is an integer of 1 to 5.

The developer is preferably a compound represented by the following general formula (2).

General formula (2)

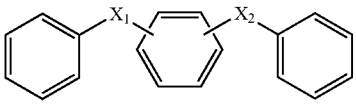

In the formula, $X_1$ is —NHCONH—, $X_2$ is —$NHSO_2$—, and each of the three benzene rings may have a substituent(s).

More preferably, the developer is N-[2-(3-phenylureido) phenyl]benzenesulfonamide.

The paper support preferably further contains polyacrylamide, and more preferably, the polyacrylamide is an amphoteric polyacrylamide in which the ratio of cationic groups to anionic groups is 50 to 200%.

The thermal recording material preferably has a backcoat layer containing a hydrophobic resin on the opposite side of the paper support from the heat-sensitive recording layer.

Advantageous Effects of Invention

The present invention can provide a thermal recording material which is excellent in all of the following characteristics: plasticizer resistance, image stability against moisture and heat, the resistance to background fogging under moisture and heat, and the retention of color developing ability.

DESCRIPTION OF EMBODIMENTS

Hereinafter, the present invention will be described in detail.

As described above, it has been known that specific compounds having a phenylureido moiety in the molecule are used as a developer in a heat-sensitive recording layer. Such thermal recording materials are excellent in plasticizer resistance and image stability against moisture and heat, but are unsatisfactory in terms of the resistance to background fogging under moisture and at, and the retention of color developing ability. The present inventor conducted extensive research to solve the above-described problems. As a result, the present inventor found that, in the production of a thermal recording material having, on a paper support, a heat-sensitive recording layer containing an ordinarily colorless or light-colored electron-donating dye precursor and a developer which reacts with the dye precursor on heating and converts the dye precursor to its colored form, the use of a compound having a phenylureido moiety in its molecule as the developer (hereinafter, a developer compound having a phenylureido moiety in its molecule is referred to also as a phenylureido developer), and the use of, as the support, a paper support containing 0.25 to 1.0% by mass of a neutral rosin sizing agent relative to the pulp solid content in combination with calcium carbonate and aluminum sulfate give a thermal recording material which is excellent in the resistance to background fogging under moisture and heat, and the retention of color developing ability, in addition to plasticizer resistance and image stability against moisture and heat. Based on this finding, the present inventor completed the present invention.

The neutral rosin sizing agent contained in the paper support of the present invention is specifically an emulsion-type rosin sizing agent. The emulsion-type rosin sizing agent is prepared by emulsification of a rosin substance by a surfactant, a water-soluble high-molecular compound or the like, which allows the use of the rosin substance in a neutral pH of 6 to 9. Examples of the rosin substance include rosins such as gum rosin, wood rosin, tall oil rosin, hydrogenated rosin, disproportionated rosin, polymerized rosin, aldehyde-modified rosin and esterified rosin; and heat-reaction products of any of the rosins with an α,β-unsaturated carboxylic acid such as acrylic acid, maleic acid, fumaric acid and itaconic acid. The emulsion-type rosin sizing agent may have been subjected to insolubilizing treatment, such as polymerization and waterproofing, which prevents the rosin substance from dissolving in a neutral pH region. The neutral rosin sizing agent used in the present invention may be a commercial product, and for example, products commercially available under the trade names of CC-1404, CC-1401, etc. from SEIKO PMC CORPORATION can be used. One of the above-mentioned neutral rosin sizing agents or two or more of them may be used as needed.

The amount of the neutral rosin sizing agent contained in the paper support of the present invention is 0.25 to 1.0% by mass relative to the pulp solid content of the paper support. When the neutral rosin sizing agent is used in an amount within this range in combination with calcium carbonate and aluminum sulfate in the paper support, a thermal recording material which is excellent in plasticizer resistance, image stability against moisture and heat, the resistance to background fogging under moisture and heat, and the retention of color developing ability can be obtained. More preferably, the amount of the neutral rosin sizing agent is 0.4 to 1.0% by mass relative to the pulp solid content. When the amount of the neutral rosin sizing agent is adjusted to this range, a thermal recording material which is particularly excellent in the retention of color developing ability can be obtained.

When the amount of the neutral rosin sizing agent is less than 0.25% by mass relative to the pulp solid content of the paper support, a sufficient level of the retention of color developing ability cannot be achieved. When the amount of the neutral rosin sizing agent is more than 1.0% by mass relative to the pulp solid content of the paper support, the retention of color developing ability may be reduced and troubles due to pitch in the neutral rosin sizing agent may occur. The neutral rosin sizing agent contained in the paper support may be an internal sizing agent or a surface sizing agent, and is preferably an internal sizing agent.

Aluminum sulfate contained in the paper support according to the present invention ensures a sufficient level of the retention of color developing ability, a sufficient level of image stability against moisture and heat, and a sufficient level of the resistance to background fogging under moisture and heat in the thermal recording material. The amount of aluminum sulfate is preferably 0.2 to 2.0% by mass relative to the pulp solid content of the paper support. When the amount of the aluminum sulfate used is in this range, a higher level of the retention of color developing ability, a higher level of image stability against moisture and heat, and a higher level of the resistance to background fogging under moisture and heat can be achieved. When the amount of aluminum sulfate is less than 0.2% by mass relative to the pulp solid content, the effect of enhancing image stability against moisture and heat and the effect of enhancing the retention of color developing ability may be reduced. When the amount of aluminum sulfate is more than 2.0% by mass relative to the pulp solid content, the effect of enhancing the resistance to background fogging under moisture and heat may be reduced.

The calcium carbonate contained in the paper support according to the present invention is, for example, precipitated calcium carbonate, wet ground calcium carbonate, dry ground calcium carbonate or the like, and any of them may be used as appropriate. Two or more of them may be used in combination. The amount of calcium carbonate is preferably 2 to 20% by mass relative to the pulp solid content of the paper support. When the amount of the calcium carbonate used is in this range, a thermal recording material in which image stability against moisture and heat, the resistance to background fogging under moisture and heat and the retention of color developing ability are at a higher level can be obtained. When the amount of calcium carbonate is less than 2% by mass relative to the pulp solid content, the effect of enhancing the resistance to background fogging under moisture and heat may be reduced. When the amount of calcium carbonate is more than 20% by mass relative to the pulp solid content, the effect of enhancing image stability against moisture and heat, the effect of enhancing the resistance to background fogging under moisture and heat, and the effect of enhancing the retention of color developing ability may be reduced.

In the present invention, it is preferable that the paper support further contains polyacrylamide because polyacrylamide provides a thermal recording material with a higher level of the retention of color developing ability. The amount of the polyacrylamide used is preferably 0.001 to 1.50% by mass relative to the pulp solid content.

The polyacrylamide used in the present invention may be a nonionic, cationic, anionic or amphoteric polyacrylamide, but preferred is an amphoteric polyacrylamide in which the ratio of cationic groups to anionic groups as represented by the following formula is 50 to 200%.

The ratio of cationic groups/anionic groups (I)=(amount of cationic Groups/amount of anionic groups)×100 Amount of cationic groups:

Mol % of cationic monomers relative to all the monomer components of the polyacrylamide Amount of anionic groups:

Mol % of anionic monomers relative to all the monomer components of the polyacrylamide The acrylamide used for the production of the polyacrylamide is, for example, acrylamide or methacrylamide, and other examples include N-substituted lower alkyl acrylamides such as N-ethylacrylamide, N-methylacrylamide, N,N-dimethylacrylamide and N-isopropylacrylamide. The acrylamide is not limited to these examples. One of these compounds or two or more of them may be used. In combination with the acrylamide, nonionic monomers such as acrylonitrile, methyl (meth)acrylate and ethyl (meth) acrylate can be used in an amount that does not adversely affect the water solubility of the acrylamide.

The cationic monomer used for the production of the polyacrylamide is, for example, a vinyl monomer having a tertiary, secondary or primary amino group, such as dimethylamino ethyl (meth) acrylate, diethylaminoethyl (meth) acrylate, dimethylaminopropyl (meth) acrylate, diethylaminopropyl (meth) acrylate, dimethylaminopropyl (meth) acrylamide, diethylaminopropvl (meth) acrylamide, alkyl diallylamine, dialkyl allylamine, diallylamine and allylamine; a salt of such a vinyl monomer with an inorganic acid such as hydrochloric acid, sulfuric acid, formic acid and acetic acid, or an organic acid; or a compound obtainable by a reaction of such a vinyl monomer with a quaternizing agent (e.g., an alkyl halide (e.g., methyl chloride, methyl bromide, etc.), an aralkyl halide (e.g., benzyl chloride, benzyl bromide, etc.), dimethyl sulfate, diethyl sulfate, epichlorohydrin, 3-chloro-2-hydroxypropy trimethyl ammonium chloride, glycidyl trialkyl ammonium chloride, etc.), for example, 2-hydroxy-N,N,N,N',N'-pentamethyl-N'-{3-[(1-oxo-2-propenyl) amino]propyl}-1,3-propane diammonium dichloride, N-ethyl-N, N-dimethyl-(2-methacryloyloxyethyl)ammonium bromide, N-benzyl-N,N-dimethyl-(2-methacryloyloxyethyl)ammonium chloride, etc. The cationic monomer is not limited to these examples. One of these compounds or two or more of them may be used. The cationic monomer accounts for preferably 0.2 to 20 mol %, and more preferably 0.2 to 10 mol % of all the monomers.

The anionic monomer used for the production of the polyacrylamide is, for example, an α,β-unsaturated monocarboxylic acid such as acrylic acid and methacrylic acid; an α,β-unsaturated dicarboxylic acid such as maleic acid, fumaric acid, itaconic acid and citraconic acid; or an unsaturated sulfonic acid such as styrene sulfonic acid and vinyl sulfonic acid, or a salt thereof (e.g., a sodium salt, a potassium salt, an ammonium salt, etc.). The anionic monomer is not limited to these examples. One of these compounds or two or more of them may be used. The anionic monomer accounts for preferably 0.2 to 20 mol %, and more preferably 0.2 to 10 mold of all the monomers.

The polyacrylamide used in the present invention may have been subjected to the Mannich reaction with formaldehyde and an amine. The degree of modification in the Mannich reaction (the molar percentage (mol %) of the formaldehyde and the amine used relative to the amide groups in the polyacrylamide) is preferably 1 to 50 mol %. In the production of polyacrylamide, the monomers may be reacted with an appropriate quaternizing agent in advance and then used for the polymerization reaction. Alternatively, a quaternization reaction using an appropriate quaternizing agent may be performed during or after the polymerization reaction of the acrylamide, the nonionic monomer, and the cationic monomer and the anionic monomer.

The polyacrylamide used in the present invention may be a branched, crosslinked or grafted polyacrylamide. The number average molecular weight of the polyacrylamide is preferably 500,000 to 4,000,000.

The polyacrylamide used in the present invention can be produced by a usual protocol. For example, the monomers as described above and water are fed into a specified reaction container, a radical polymerization initiator is added, and the mixture is heated with stirring to give a polyacrylamide of interest. The reaction temperature is usually about 50 to 100° C., and the reaction time is about 1 to 5 hours. The way of feeding the monomers depends on the type of the polymerization process employed, which can be a conventionally known one such as simultaneous polymerization and continuous addition polymerization. The radical polymerization initiator used can be a commonly used radical polymerization initiator, and is, for example, a persulfate such as potassium persulfate and ammonium persulfate, or a redox polymerization initiator, which is a combination of such a persulfate and a reductant such as sodium hydrogen sulfite. In addition, an azo initiator can also be used as the radical polymerization initiator. The amount of the radical polymerization initiator used is about 0.05 to by mass relative to the total amount of the monomers. For the adjustment of the polymerization degree of the polyacrylamide, known chain transfer agents such as thiols, thiolic acids, secondary alcohols and phosphinates may be used.

Examples of the pulp used for the production of the paper support in the present invention include various types of pulp such as nadelholz bleached kraft pulp (NBKP), laubholz bleached kraft pulp (LBKP), nadelholz bleached sulfite pulp (NBSP), laubholz bleached sulfite pulp (LBSP), thermomechanical pulp (TMP), chemi-thermomechanical pulp (CTMP), bleached chemi-thermomechanical pulp (BCTMP), ground pulp (GP), refiner ground pulp (RGP), chemical ground pulp (CGP) and cotton pulp; various types of recycled pulp such as deinked pulp (DIP); and non-wood fibers such as kenaf. One of these materials or two or more of them may be used as needed.

The paper support in the present invention can contain a filler, and for example, the above-mentioned calcium carbonate can be used as the filler. Other known fillers can also be used as appropriate unless the effects of the present invention are hindered. Examples of such fillers include inorganic fillers such as talc, kaolin, calcined kaolin, amorphous silica, illite, clay and titanium dioxide; and organic fillers such as plastic pigments, but highly basic fillers, such as calcium hydroxide, are not preferred. The filler contained in the paper support in the present invention is preferably a combination of calcium carbonate with at least one kind selected from talc, kaolin and calcined kaolin. In this embodiment, a thermal recording material which is particularly excellent in the retention of color developing ability can be obtained. The percentage of calcium carbonate in the filler as a whole is preferably 20 to 70% by mass.

The ash content of the paper support in the present invention is preferably 5 to 25% by mass, and more preferably 7 to 20% by mass. When the ash content of the paper support is less than 5% by mass, good formation and sufficient smoothness can hardly be achieved. When the ash content of the paper support exceeds 25% by mass, the smoothness stays at a maximum level, but the sizing degree and the surface strength of the paper support is reduced, which results in easy occurrence of paper breaks during the coating for the formation of an undercoat layer and a heat-sensitive recording layer.

According to the present invention, the paper support can further contain various types of internal sizing agents such as alkyl ketene dimers, alkenyl succinic anhydrides and higher fatty acids in addition to the neutral rosin sizing agent. In this embodiment, the total amount of the internal sizing agents other than the neutral rosin sizing agent is preferably 50% by mass or less, and more preferably 30% by mass or less relative to the solid content of the neutral rosin sizing agent. Moreover, in the paper support, in addition to the above-mentioned neutral rosin sizing agent, aluminum sulfate, calcium carbonate, polyacrylamide, pulp and filler, various kinds of internal additives for papermaking can be used if needed. Examples of such internal additives include nonionic, cationic, anionic or amphoteric retention aids, drainage aids and strengthening agents. Specific examples of the retention aids, the drainage aids and the strengthening agents include polyvalent metal compounds such as aluminum (specifically, aluminum chloride, sodium aluminate, basic aluminum compounds, etc.), amorphous silica, various kinds of starch, urea resin, polyamide-polyamine resin, polyethyleneimine, polyamine, polyvinyl alcohol and polyethylene oxide. The polyacrylamide used in the present invention can serve as a retention aid, a drainage aid, a strengthening agent and/or the like as well. Moreover, the total amount of the water-soluble high-molecular compounds in the paper support, as typified by the above-mentioned various types of starch, polyvinyl alcohol and polyacrylamide, is preferably 0.1 to 1.5% by mass relative to the pulp solid content. In this embodiment, a thermal recording material which is excellent in the retention of color developing ability can be obtained.

The basis weight of the paper support in the thermal recording material of the present invention is preferably 30 to 180 g/m$^2$, and can be adjusted to this range as appropriate. The papermaking conditions for the production of the paper support are not particularly limited. The paper machine to be used for the production of the paper support can be selected as appropriate for the desired purpose from commercial-scale paper machines such as a Fourdrinier paper machine, a gap former-type paper machine, a cylinder paper machine, and a short wire-type paper machine. The paper support may have been subjected to surface sizing treatment with a known natural adhesive such as starch, a known synthetic adhesive such as polyvinyl alcohol or a known sizing agent. For the surface sizing treatment, a size press, a roll coater, etc. can be used.

In the present invention, calendering is preferably performed using a machine calender, a soft nip calender, a super calender or the like. In this embodiment, a smooth paper support can be obtained. More preferably, thermal calendering is performed. In this embodiment, a thermal recording material which is excellent in the retention of color developing ability can be obtained.

For the improvement of the smoothness, heat-insulating property and other properties of the paper support, or for the prevention of the components contained in the paper support from adversely affecting the heat-sensitive recording layer, it is preferable that the thermal recording material of the present invention contains an undercoat layer between the paper support and the heat-sensitive recording layer. The undercoat layer contains a binder and an inorganic or organic pigment, and hollow particles can also be contained in the undercoat layer. The undercoat layer can contain other components, which are exemplified by known surfactants, coloring dyes, fluorescent dyes, lubricants, ultraviolet absorbers, etc.

Examples of the pigment contained in the undercoat layer of the present invention include inorganic pigments such as talc, kaolin, calcined kaolin, ground calcium carbonate, precipitated calcium carbonate, magnesium carbonate, zinc oxide, aluminum oxide, aluminum hydroxide, magnesium hydroxide, titanium dioxide, barium sulfate, zinc sulfate, amorphous silica, calcium silicate and colloidal silica; and organic pigments such as melamine resin, urea-formalin resin, polyethylene, polystyrene and an ethylene-vinyl acetate copolymer. One of these pigments or a combination of two or more of them may be used. Particularly preferred are silicate minerals such as talc, kaolin and calcined kaolin. The amount of the silicate mineral in the undercoat layer is preferably 20% by mass or more, and more preferably 60 to 90% by mass relative to the total solid content of the undercoat layer, which ensures a sufficient level of image stability against moisture and heat and a sufficient level of the retention of color developing ability. Considering that basic pigments such as calcium hydroxide may deteriorate image stability against moisture and heat and the retention of color developing ability, the basic pigment content is preferably limited to 20% by mass or less relative to the total solid content of the undercoat layer.

As the binder in the undercoat layer, various water-soluble or water-dispersible high-molecular compounds used for conventional coating can be used. Specific examples of such compounds include, but are not limited to, water-soluble high-molecular compounds such as starch, hydroxymethyl cellulose, methyl cellulose, ethyl cellulose, carboxymethyl cellulose, gelatin, casein, fully-saponified polyvinyl alcohol, partially-saponified polyvinyl alcohol, modified polyvinyl alcohol, sodium alginate, polyvinyl pyrrolidone, polyacrylamide, an acrylamide/acrylic acid ester copolymer, an acrylamide/acrylic acid ester/methacrylic acid terpolymer, an alkali salt of polyacrylic acid, an alkali salt of polymaleic acid, an alkali salt of a styrene/maleic anhydride copolymer, an alkali salt of an ethylene/maleic anhydride copolymer and an alkali salt of an isobutylene/maleic anhydride copolymer; and water-dispersible high-molecular compounds such as a styrene/butadiene copolymer, an acrylonitrile/butadiene copolymer, a methyl acrylate/butadiene copolymer, an acrylonitrile/butadiene/styrene terpolymer, polyvinyl acetate, a vinyl acetate/acrylic acid ester copolymer, an ethylene/vinyl acetate copolymer, polyacrylic acid ester, a styrene/acrylic acid ester copolymer and polyurethane. The binder used may be of one kind or a combination of two kinds or more. The amount of the binder used is preferably 10 to 30% by mass relative to the total solid content of the undercoat layer. In this embodiment, a thermal recording material which is excellent in the retention of color developing ability can be obtained.

For the formation of the undercoat layer in the present invention, a coating liquid for undercoat layer formation is prepared by stirring a mixture of a medium such as water and a pigment, and if needed a binder and other auxiliary agents, then applied onto a paper support in such an amount that the coating weight after drying will be preferably to 30 $g/m^2$, more preferably 4 to 20 $g/m^2$, and finally dried.

According to the present invention, when the mixture of a medium such as water and the components to be contained in the undercoat layer is stirred, a dispersant can be used to enhance the dispersibility of the components. Examples of the dispersant include water-soluble high-molecular compounds such as polyvinyl alcohols (e.g., fully-saponified polyvinyl alcohol, partially-saponified polyvinyl alcohol, modified polyvinyl alcohol, etc.), starch or its derivatives, cellulose derivatives (e.g., hydroxyethyl cellulose, methyl cellulose, hydroxypropyl cellulose, ethyl cellulose, carboxymethyl cellulose, etc.), proteins (e.g., gelatin, casein, etc.), acid neutralizers for chitosan, sodium alginate, polyvinyl pyrrolidone, salts of a diisobutylene/maleic anhydride copolymer, salts of a styrene/isobutylene/maleic anhydride copolymer, salts of a styrene/maleic anhydride copolymer, salts of an ethylene/acrylic acid copolymer, salts of a styrene/acrylic acid copolymer, polyacrylates and polyacrylic sulfonates; low-molecular anionic surfactants such as dodecylbenzene sulfonates, dialkyl sulfosuccinates, alkylnaphthalene sulfonates, alkyl diphenyl ether disulfonates and fatty acid metal salts; nonionic surfactants such as acetylene glycol; and sodium hexametaphosphate. The dispersant is not limited to these examples. One of these compounds or two or more of them may be used as needed. The amount of the dispersant is preferably 0.1 to 30% by mass relative to the total amount of the components of the undercoat layer.

The heat-sensitive recording layer in the thermal recording material of the present invention contains a phenylureido developer. A combination of a heat-sensitive recording layer containing such a developer with the paper support of the present invention can provide a thermal recording material which is excellent in plasticizer resistance, image stability against moisture and heat, the resistance to background fogging under moisture and heat, and the retention of color developing ability.

The phenylureido developer used in the present invention is a compound having a phenylureido moiety in its molecule. The phenylureido moiety is preferably represented by the above general formula (1). R1, R3 and R4 in the general formula (1) are, for example, a hydrogen atom; a group that can be a substituent at the nitrogen atoms or a substituent on the benzene ring in the general formula (1), which includes an alkyl group, an alkenyl group, an alkynyl group, an aralkyl group, an aryl group, a carboxyl group, a carbonyl group, a hydroxy group, an acyl group, an acyloxy group, an alkoxycarbonyl group, a mercapto group, an amino group, a carbamide group, a nitro group, a cyano group, a formyl group, a sulfo group, a sulfonyl group, a sulfinyl group, a tosyl group, an azo group, a halogen atom, an alkoxy group, an alkenyloxy group, an aryloxy group and a group having an ester bond, such as a carboxyl ester, a thioester, a sulfate ester, a phosphate ester and a carbonate ester; or a group formed by binding of any two or more of the above-listed groups and atoms. R1, R3 and R4 may be groups or atoms which are different from each other. R1 and R3 are preferably hydrogen atoms. R4 is preferably a hydrogen atom, an alkyl group, an aryl group, a carbonyl group, a carbamide group, a hydroxy group, an amino group, a tosyl group, a sulfonyl group, or a group formed by binding of any two or more of the foregoing groups. R2 is, for example, an oxygen atom, a sulfur atom or the like, and preferably an oxygen atom. n in the general formula (1) represents an integer of 1 to 5.

The phenylureido developer used in the present invention is preferably a compound not having a phenolic moiety in its molecule. Examples of such a compound include 4,4'-bis[(4-methyl-3-phenoxycarbonylaminophenyl)ureido]diphenylsulfone, 3-(3-tosylureido)phenyl p-toluenesulfonate, N-[2-(3-phenylureido)phenyl]benzenesulfonamide, N-(2-{[(4-methylphenyl)carbamoyl]amino}phenyl)benzenesulfonamide, 4-methyl-N-{2-[(phenylcarbamoyl)amino]phenyl}benzenesulfonamide, 4-methyl-N-(2-{[(4-methylphenyl)carbamoyl]amino}phenyl)benzenesulfonamide, n-butyl-4-[3-(p-toluenesulfonyl)ureido]benzoate, 3,3'-(4,4'-methylenediphenyl)bis(ureido p-trissulfone), bis{3-[3'-(p-toluenesulfonyl)ureido]benzoate}, 1,5-(3-oxopentylene) bis{3'-[3'-(p-toluenesulfonyl)ureido]benzoate} and derivatives of N-phenylsulfonyl-N'-phenylurea. The phenylureido developer is not limited to these examples. One of these compounds or a combination of two or more of them may be used. Commercial products of such a phenylureido developer can also be used, and for example, the product commercially available under the trade name of PERGAFAST 201 from BASF Japan Ltd. and the product commercially available under the trade name of UU from Chemipro Kasei Kaisha, Ltd. can be used.

Among the above-listed phenylureido developers, 4,4'-bis[(4-methyl-3-phenoxycarbonylaminophenyl)ureido]diphenylsulfone, 3-(3-tosylureido)phenyl p-toluenesulfonate and a compound represented by the above general formula (2) are preferably used for a higher level of plasticizer resistance. In the general formula (2), $X_1$ is —NHCONH—, and $X_2$ is, for example, —NHCO—, —CONH—, —NHCONH—, —CONHNHCO—, —NHCOCONH—, —$SO_2$NH—, —$NHSO_2$— or the like. Particularly preferred is a compound of the general formula (2) in which $X_2$ is —$NHSO_2$—. Each of the three benzene rings in the compound represented by the general formula (2) may have a substituent(s).

Examples of the compound of the general formula (2) in which $X_1$ is —NHCONH— and $X_2$ is —$NHSO_2$— include N-[2-(3-phenylureido)phenyl]benzenesulfonamide, N-(2-{[(4-methylphenyl)carbamoyl]amino}phenyl)benzenesulfonamide, 4-methyl-N-{2-[(phenylcarbamoyl)amino]phenyl}benzenesulfonamide and 4-methyl-N-(2-{[(4-methylphenyl)carbamoyl]amino}phenyl)benzenesulfonamide. Particularly preferred is N-[2-(3-phenylureido)phenyl]benzenesulfonamide. In the case where N-[2-(3-phenylureido)phenyl]benzenesulfonamide is used, a thermal recording material which is particularly excellent in the resistance to background fogging under moisture and heat, and the retention of color developing ability in addition to plasticizer resistance can be obtained.

According to the present invention, in order to ensure a sufficient level of plasticizer resistance, a sufficient level of image stability against moisture and heat, a sufficient level of the resistance to background fogging under moisture and heat, and a sufficient level of the retention of color developing ability, the total amount of the phenylureido developers is preferably 0.1 to 50% by mass, and more preferably 1 to 30% by mass relative to the total solid content of the heat-sensitive recording layer.

As the colorless or light-colored dye precursor in the heat-sensitive recording layer, electron-donating compounds generally used in pressure-sensitive recording materials and thermal recording materials may be used without limitation One of such compounds or a combination of two or more of them may be used as needed. Specific examples of the dye precursor include the following compounds, but are not limited thereto.

Exemplary black dye precursors include 3-di-n-butylamino-6-methyl-7-anilinofluoran,
3-di-n-pentylamino-6-methyl-7-anilinofluoran,
3-diethylamino-6-methyl-7-anilinofluoran,
3-di-n-butylamino-7-(2-chloroanilino)fluoran,
3-diethylamino-7-(2-chloroanilino)fluoran,
3-diethylamino-6-methyl-7-xylidinofluoran,
3-diethylamino-7-(2-carbomethoxyphenylamino)fluoran,
3-(N-cyclohexyl-N-methyl)amino-6-methyl-7-anilinofluoran,
3-(N-cyclopentyl-N-ethyl)amino-6-methyl-7-anilinofluoran,
3-(N-isoamyl-N-ethyl)amino-6-methyl-7-anilinofluoran,
3-(N-ethyl-4-toluidino)-6-meth 7-anilinofluoran,
3-(N-ethyl-4-toluidino)-6-methyl-7-(4-toluidino)fluoran,
3-(N-methyl-N-tetrahydrofurfuryl)amino-6-methyl-7-anilinofluoran,
3-pyrrolidino-6-methyl-7-anilinofluoran,
3-pyrrolidino-6-methyl-7-(4-n-butylphenylamino)fluoran and
3-piperidino-6-methyl-7-anilinofluoran. One of these dye precursors or a mixture of two or more of them may be used.

Exemplary red dye precursors include 3,3-bis(1-n-butyl-2-methylindol-3-yl)phthalide,
3,3-bis(1-n-butyl-2-methylindol-3-yl)tetrachlorophthalide,
3,3-bis(1-n-butylindol-3-yl)phthalide,
3,3-bis(1-n-pentyl-2-methylindol-3-yl)phthalide,
3,3-bis(1-n-hexyl-2-methylindol-3-yl)phthalide,
3,3-bis(1-n-octyl-2-methylindol-3-yl)phthalide,
3,3-bis(1-methyl-2-methylindol-3-yl)phthalide,
3,3-bis(1-ethyl-2-methylindol-3-yl)phthalide,
3,3-bis(1-propyl-2-methylindol-3-yl)phthalide,
3,3-bis(2-methylindol-3-yl)phthalide, rhodamine B-anilinolactam, rhodamine B-(o-chloroanilino)lactam, rhodamine B-(p-nitroanilino)lactam,
3-diethylamino-5-methyl-7-dibenzylaminofluoran,
3-diethylamino-6-methyl-7-chlorofluoran,
3-diethylamino-6-methoxyfluoran,
3-diethylamino-6-methylfluoran,
3-diethylamino-6-methyl-7-chloro-8-benzylfluoran,
3-diethylamino-6,7-dimethylfluoran,
3-diethylamino-6,8-dimethylfluoran,
3-diethylamino-7-chlorofluoran,
3-diethylamino-7-methoxyfluoran,
3-diethylamino-7-(N-acetyl-N-methyl)aminofluoran,
3-diethylamino-7-methylfluoran,
3-diethylamino-7-n-propoxyfluoran,
3-diethylamino-7-p-methylphenylfluoran,
3-diethylamino-7,8-benzofluoran,
3-diethylaminobenzo[a]fluoran,
3-diethylaminobenzo[c]fluoran,
3-dimethylamino-7-methoxyfluoran,
3-dimethylamino-6-methyl-7-chlorofluoran,
3-dimethylamino-7-methylfluoran,
3-dimethylamino-7-chlorofluoran,
3-(N-ethyl-p-toluidino)-7-methylfluoran,
3-(N-ethyl-N-isoamyl)amino-6-methyl-7-chlorofluoran,
3-(N-ethyl-N-isoamyl)amino-7,8-benzofluoran,
3-(N-ethyl-N-isoamyl)amino-7-methylfluoran,
3-(N-ethyl-N-n-octyl)amino-6-methyl-7-chlorofluoran,
3-(N-ethyl-N-n-octyl)amino-7,8-benzofluoran,
3-(N-ethyl-N-n-octyl)amino-7-methylfluoran,
3-(N-ethyl-N-n-octyl)amino-7-chlorofluoran,
3-(N-ethyl-N-4-methylphenyl)amino-7,8-benzofluoran,
3-(N-ethoxyethyl-N-ethyl)amino-7,8-benzofluoran,
3-(N-ethoxyethyl-N-ethyl)amino-7-chlorofluoran,
3-n-dibutylamino-6-methyl-7-chlorofluoran,
3-n-dibutylamino-7,8-benzofluoran,
3-n-dibutylamino-7-chlorofluoran,
3-n-dibutylamino-7-methylfluoran,
3-diallylamino-7,8-benzofluoran,
3-diallylamino-7-chlorofluoran,
3-di-n-butylamino-6-methyl-7-bromofluoran,
3-cyclohexylamino-6-chlorofluoran,
3-pyrrolidylamine-7-methylfluoran,
3-ethylamino-7-methylfluoran,
3-(N-ethyl-N-isoamyl)amino-benzo[a]fluoran,
3-n-dibutylamino-6-methyl-7-bromofluoran and
3,6-bis(diethylaminofluoran)-γ-(4'-nitro)anilinolactam. One of these dye precursors or a mixture of two or more of them may be used.

Exemplary green dye precursors include 3-(N-ethyl-N-n-hexyl)amino-7-anilinofluoran,
3-(N-ethyl-N-p-tolyl)amino-7-(N-phenyl-N-methyl)aminofluoran,
3-(N-ethyl-N-n-propyl)amino-7-dibenzylaminofluoran,
3-(N-ethyl-N-n-propyl)amino-6-chloro-7-dibenzylaminofluoran,
3-(N-ethyl-N-4-methylphenyl)amino-7-(N-methyl-N-phenyl)aminofluoran,
3-(N-ethyl-4-methylphenyl)amino-7-dibenzylaminofluoran,
3-(N-ethyl-4-methylphenyl)amino-6-methyl-7-dibenzylaminofluoran, 3-(N-ethyl-4-methylphenyl)amino-6-methyl-7-(N-methyl-N-benzyl)aminofluoran,
3-(N-methyl-N-n-hexyl)amino-7-anilinofluoran,
3-(N-propyl-N-n-hexyl)amino-7-anilinofluoran,
3-(N-ethoxy-N-n-hexyl)amino-7-anilinofluoran,
3-(N-n-pentyl-N-allyl)amino-6-methyl-7-anilinofluoran,
3-(N-n-pentyl-N-allyl)amino-7-anilinofluoran,
3-di-n-butylamino-6-chloro-7-(2-chloroanilino)fluoran,
3-di-n-butylamino-6-methyl-7-(2-chloroanilino)fluoran,
3-di-n-butylamino-6-methyl-7-(2-fluoroanilino)fluoran,
3-n-dibutylamino-7-(2-chloroanilino)fluoran,
3-di-n-butylamino-7-(2-chlorobenzylanilino)fluoran,
3,3-bis(4-diethylamino-2-ethoxyphenyl)-4-azaphthalide,
3,6-bis(dimethylamino)fluorene-9-Spiro-3'-(6'-dimethylamino)phthalide,
3-diethylamino-6-methyl-7-benzylaminofluoran,
3-diethylamino-6-methyl-7-dibenzylaminofluoran,
3-diethylamino-6-methyl-7-n-octylaminofluoran,
3-diethylamino-6-methyl-7-(N-cyclohexyl-N-benzyl)aminofluoran,
3-diethylamino-6-methyl-7-(2-chloroanilino)fluoran,
3-diethylamino-6-methyl-7-(2-trifluoromethylanilino)fluoran,
3-diethylamino-6-methyl-7-(3-trifluoromethylanilino)fluoran,
3-diethylamino-6-methyl-7-(2-ethoxyanilino)fluoran,
3-diethylamino-6-methyl-7-(4-ethoxyanilino)fluoran,
3-diethylamino-6-chloro-7-(2-chloroanilino)fluoran,
3-diethylamino-6-chloro-7-dibenzylaminofluoran,
3-diethylamino-6-chloro-7-anilinofluoran,
3-diethylamino-6-ethylethoxy-7-anilinofluoran,
3-diethylamino-7-anilinofluoran,
3-diethylamino-7-methylanilinofluoran,
3-diethylamino-7-dibenzylaminofluoran,
3-diethylamino-7-n-octylaminofluoran,
3-diethylamino-7-p-chloroanilinofluoran,
3-diethylamino-7-p-methylphenylanilinofluoran,
3-diethylamino-7-(N-cyclohexyl-N-benzyl)aminofluoran,
3-diethylamino-7-(2-chloroanilino)fluoran,
3-diethylamino-7-(3-trifluoromethylanilino)fluoran,
3-diethylamino-7-(2-trifluoromethylanilino)fluoran,
3-diethylamino-7-(2-ethoxyanilino)fluoran,
3-diethylamino-7-(4-ethoxyanilino)fluoran,
3-diethylamino-7-(2-chlorobenzylanilino)fluoran,
3-dimethylamino-6-chloro-7-dibenzylaminofluoran,
3-dimethylamino-6-methyl-7-n-octylaminofluoran,
3-dimethylamino-7-dibenzylaminofluoran,
3-dimethylamino-7-n-octylaminofluoran,
3-di-n-butylamino-7-(2-fluoroanilino)fluoran,
3-anilino-7-dibenzylaminofluoran,
3-anilino-6-methyl-7-dibenzylaminofluoran,
3-pyrrolidino-7-dibenzylaminofluoran,
3-pyrrolidino-7-(4-cyclohexylanilino)fluoran,
3-dibenzylamino-6-methyl-7-dibenzylaminofluoran,
3,7-bis(dibenzylamino)fluoran and
3-dibenzylamino-7-(2-chloroanilino)fluoran. One of these dye precursors or a mixture of two or more of them may be used.

Exemplary blue dye precursors include 3-(1-ethyl-2-methylindol-3-yl)-3-(4-diethylaminophenyl)phthalide,
3-(1-ethyl-2-methylindol-3-yl)-3-(2-methyl-4-diethylaminophenyl)-4-azaphthalide,
3-(1-ethyl-2-methylindol-3-yl)-3-(2-ethoxy-4-aminophenyl)-4-azaphthalide,
3-(1-ethyl-2-methylindol-3-yl)-3-(2-ethoxy-4-methylaminophenyl)-4-azaphthalide,
3-(1-ethyl-2-methylindol-3-yl)-3-(2-ethoxy-4-ethylaminophenyl)-4-azaphthalide,
3-(1-ethyl-2-methylindol-3-yl)-3-(2-ethoxy-4-dimethylaminophenyl)-4-azaphthalide,
3-(1-ethyl-2-methylindol-3-yl)-3-(2-ethoxy-4-diethylaminophenyl)-4-azaphthalide,
3-(1-ethyl-2-methylindol-3-yl)-3-(2-ethoxy-4-di-n-propylaminophenyl)-4-azaphthalide,
3-(1-ethyl-2-methylindol-3-yl)-3-(2-ethoxy-4-di-n-butylaminophenyl)-4-azaphthalide,
3-(1-ethyl-2-methylindol-3-yl)-3-(2-ethoxy-4-di-n-pentylaminophenyl)-4-azaphthalide,
3-(1-ethyl-2-methylindol-3-yl)-3-(2-ethoxy-4-di-n-hexylaminophenyl)-4-azaphthalide,
3-(1-ethyl-2-methylindol-3-yl)-3-(2-ethoxy-4-dihydroxyaminophenyl)-4-azaphthalide,
3-(1-ethyl-2-methylindol-3-yl)-3-(2-ethoxy-4-dichloroaminophenyl)-4-azaphthalide,
3-(1-ethyl-2-methylindol-3-yl)-3-(2-ethoxy-4-dibromoaminophenyl)-4-azaphthalide,
3-(1-ethyl-2-methylindol-3-yl)-3-(2-ethoxy-4-diallyiaminophenyl)-4-azaphthalide,
3-(1-ethyl-2-methylindol-3-yl)-3-(2-ethoxy-4-dimethoxyamino phenyl)-4-azaphthalide,
3-(1-ethyl-2-methylindol-3-yl)-3-(2-ethoxy-4-diethoxyaminophenyl)-4-azaphthalide,
3-(1-ethyl-2-methylindol-3-yl)-3-(2-ethoxy-4-dicyclohexylaminophenyl)-4-azaphthalide,
3-(1-ethyl-2-methylindol-3-yl)-3-(2-ethoxy-4-di-n-propoxyaminophenyl)-4-azaphthalide,
3-(1-ethyl-2-methylindol-3-yl)-3-(2-ethoxy-4-di-n-butoxyaminophenyl)-4-azaphthalide,
3-(1-ethyl-2-methylindol-3-yl)-3-(2-ethoxy-4-di-n-hexyloxyaminophenyl)-4-azaphthalide,
3-(1-ethyl-2-methylindol-3-yl)-3-(2-ethoxy-4-di-methylcyclohexylaminophenyl)-4-azaphthalide,
3-(1-ethyl-2-methylindol-3-yl)-3-(2-ethoxy-4-di-methoxycyclohexylaminophenyl)-4-azaphthalide,
3-(1-ethyl-2-methylindol-3-yl)-3-(2-ethoxy-4-pyrrolidylaminophenyl)-4-azaphthalide,
3-(1-ethyl-2-methylindol-3-yl)-3-(3-ethoxy-4-diethylaminophenyl)-4-azaphthalide,
3-(1-ethyl-2-methylindol-3-yl)-3-(2,3-diethoxy-4-diethylaminophenyl)-4-azaphthalide,
3-(1-ethyl-2-methylindol-3-yl)-3-(4-diethylaminophenyl)-4-azaphthalide,
3-(1-ethyl-2-methylindol-3-yl)-3-(2-chloro-4-diethylaminophenyl)-4-azaphthalide,
3-(1-ethyl-2-methylindol-3-yl)-3-(3-chloro-4-diethylaminophenyl)-4-azaphthalide,
3-(1-ethyl-2-methylindol-3-yl)-3-(2-bromo-4-diethylaminophenyl)-4-azaphthalide,
3-(1-ethyl-2-methylindol-3-yl)-3-(3-bromo-4-diethylaminophenyl)-4-azaphthalide,
3-(1-ethyl-2-methylindol-3-yl)-3-(2-ethyl-4-diethylaminophenyl)-4-azaphthalide,
3-(1-ethyl-2-methylindol-3-yl)-3-(2-n-propyl-4-diethylaminophenyl)-4-azaphthalide,
3-(1-ethyl-2-methylindol-3-yl)-3-(3-methyl-4-diethylaminophenyl)-4-azaphthalide,
3-(1-ethyl-2-methylindol-3-yl)-3-(2-nitro-4-diethylaminophenyl)-4-azaphthalide,
3-(1-ethyl-2-methylindol-3-yl)-3-(2-allyl-4-diethylaminophenyl)-4-azaphthalide,
3-(1-ethyl-2-methylindol-3-yl)-3-(2-hydroxy-4-diethylaminophenyl)-4-azaphthalide, 3-(1-ethyl-2-methylindol-3-yl)-3-(2-cyano-4-diethylaminophenyl)-4-azaphthalide,
3-(1-ethyl-2-methylindol-3-yl)-3-(2-cyclohexylethoxy-4-diethylaminophenyl)-4-azaphthalide,
3-(1-ethyl-2-methylindol-3-yl)-3-(2-methylethoxy-4-diethylaminophenyl)-4-azaphthalide,
3-(1-ethyl-2-methylindol-3-yl)-3-(2-cyclohexylethyl-4-diethylaminophenyl)-4-azaphthalide,
3-(2-ethylindol-3-yl)-3-(2-ethoxy-4-diethylaminophenyl)-4-azaphthalide,
3-(1-ethyl-2-chloroindol-3-yl)-3-(2-ethoxy-4-diethylaminophenyl)-4-azaphthalide,
3-(1-ethyl-2-bromoindol-3-yl)-3-(2-ethoxy-4-diethylaminophenyl)-4-azaphthalide,
3-(1-ethyl-2-ethylindol-3-yl)-3-(2-ethoxy-4-diethylaminophenyl)-4-azaphthalide,
3-(1-ethyl-2-propylindol-3-yl)-3-(2-ethoxy-4-diethylaminophenyl)-4-azaphthalide,
3-(1-ethyl-2-methoxyindol-3-yl)-3-(2-ethoxy-4-diethylaminophenyl)-4-azaphthalide,
3-(1-ethyl-2-ethoxyindol-3-yl)-3-(2-ethoxy-4-diethylaminophenyl)-4-azaphthalide,
3-(1-ethyl-2-phenylindol-3-yl)-3-(2-ethoxy-4-diethylaminophenyl)-4-azaphthalide,
3-(1-ethyl-2-methylindol-3-yl)-3-(2-ethoxy-4-diethylaminophenyl)-7-azaphthalide,
3-(1-ethyl-2-methylindol-3-yl)-3-(2-ethoxy-4-diethylaminophenyl)-4,7-diazaphthalide,
3-(1-ethyl-4,5,6,7-tetrachloro-2-methylindol-3-yl)-3-(2-ethoxy-4-diethylaminophenyl)-4-azaphthalide,
3-(1-ethyl-4-nitro-2-methylindol-3-yl)-3-(2-ethoxy-4-diethylaminophenyl)-4-azaphthalide,
3-(1-ethyl-4-methoxy-2-methylindol-3-yl)-3-(2-ethoxy-4-diethylaminophenyl)-4-azaphthalide,
3-(1-ethyl-4-methylamino-2-methylindol-3-yl)-3-(2-ethoxy-4-diethylaminophenyl)-4-azaphthalide,
3-(1-ethyl-4-methyl-2-methylindol-3-yl)-3-(2-ethoxy-4-diethylaminophenyl)-4-azaphthalide,
3-(2-methylindol-3-yl)-3-(2-ethoxy-4-diethylaminophenyl)-4-azaphthalide,
3-(1-chloro-2-methylindol-3-yl)-3-(2-ethoxy-4-diethylaminophenyl)-4-azaphthalide,
3-(1-bromo-2-methylindol-3-yl)-3-(2-ethoxy-4-diethylaminophenyl)-4-azaphthalide,
3-(1-methyl-2-methylindol-3-yl)-3-(2-ethoxy-4-diethylaminophenyl)-4-azaphthalide,
3-(1-methyl-2-methylindol-3-yl)-3-(2-ethoxy-4-diethylaminophenyl)-7-azaphthalide,
3-(1-n-propyl-2-methylindol-3-yl)-3-(2-ethoxy-4-diethylaminophenyl)-4-azaphthalide,
3-(1-n-butyl-2-methylindol-3-yl)-3-(2-ethoxy-4-diethylaminophenyl)-4-azaphthalide,
3-(1-n-butyl-2-indol-3-yl)-3-(2-ethoxy-4-diethylaminophenyl)-7-azaphthalide,
3-(1-n-pentyl-2-methylindol-3-yl)-3-(2-ethoxy-4-diethylaminophenyl)-4-azaphthalide,
3-(1-n-hexyl-2-methylindol-3-yl)-3-(2-ethoxy-4-diethylaminophenyl)-4-azaphthalide,
3-(1-n-hexyl-2-methylindol-3-yl)-3-(2-ethoxy-4-diethylaminophenyl)-7-azaphthalide,
3-(1-n-octyl-2-methylindol-3-yl)-3-(2-ethoxy-4-diethylaminophenyl)-4-azaphthalide,
3-(1-n-octyl-2-methylindol-3-yl)-3-(2-ethoxy-4-diethylaminophenyl)-7-azaphthalide,
3-(1-n-octyl-2-methylindol-3-yl)-3-(2-ethoxy-4-diethylaminophenyl)-4,7-diazaphthalide,
3-(1-n-nonyl-2-methylindol-3-yl)-3-(2-ethoxy-4-diethylaminophenyl)-4-azaphthalide,
3-(1-methoxy-2-methylindol-3-yl)-3-(2-ethoxy-4-diethylaminophenyl)-4-azaphthalide,
3-(1-ethoxy-2-methylindol-3-yl)-3-(2-ethoxy-4-diethylaminophenyl)-4-azaphthalide,
3-(1-phenyl-2-methylindol-3-yl)-3-(2-ethoxy-4-diethylaminophenyl)-4-azaphthalide,
3-(1-n-pentyl-2-methylindol-3-yl)-3-(2-ethoxy-4-diethylaminophenyl)-7-azaphthalide,
3-(1-n-heptyl-2-methylindol-3-yl)-3-(2-ethoxy-4-diethylaminophenyl)-7-azaphthalide,
3-(1-n-nonyl-2-methylindol-3-yl)-3-(2-ethoxy-4-diethylaminophenyl)-7-azaphthalide,
3,3-bis(4-dimethylaminophenyl)-6-dimethylaminophthalide,
3-(4-dimethylamino-2-methylphenyl)-3-(4-dimethylaminophenyl)-6-dimethylaminophthalide and
3-(1-ethyl-2-methylindol-3-yl)-3-(4-diethylamino-2-n-hexyloxyphenyl)-4-azaphthalide. One of these dye precursors or a mixture of two or more of them may be used.

In addition, the dye precursor encompasses functional dye precursors, for example, dye precursors for the development of near-infrared absorbing images. In the case where this kind of dye precursor is used as a dye precursor for color development under high temperature, alone or in combination with one or more other dye precursors, an image having near-infrared absorption can be obtained by color development under high temperature and used as an image automatically readable under near infrared light. The use of this kind of dye precursor in the present invention enables a combination use of an image having absorption only in the visible light region, an image having absorption in the near-infrared region, and one or more other images, leading to the production of a recording material with a high level of security.

Examples of the dye precursor for the development of near-infrared absorbing images include
3,3-bis[1-(4-methoxyphenyl)-1-(4-dimethylaminophenyl)ethylen-2-yl]-4,5,6,7-tetrachlorophthalide,
3,3-bis[1-(4-methoxyphenyl)-1-(4-pyrrolidinopenyl)ethylen-2-yl]-4,5,6,7-tetrachlorophthalide,
3,3-bis[1,1-bis(4-pyrrolidinophenyl)ethylen-2-yl]-4,5,6,7-tetrabromophthalide,
3-[1,1-bis(p-diethylaminophenyl)ethylen-2-yl]-6-dimethylaminophthalide,
3,6-bis(dimethylamino)fluorene-9-Spiro-3'-(6'-dimethylamino)phthalide,
3-[p-(p-dimethylaminoanilino)anilino]-6-methylfluoran,
3-[p-(p-dimethylaminoanilino)anilino]-6-methyl-7-chlorofluoran,
3-(p-n-butylaminoanilino)-6-methyl-7-chlorofluoran,
3-[p-(p-anilinoanilino)anilino]-6-methyl-7-chlorofluoran,
3-[p-(p-chloroanilino)anilino]-6-methyl-7-chlorofluoran,
3-(N-p-tolyl-N-ethylamino)-6,8,8-trimethyl-9-ethyl-8,9-dihydro-(3,2-e)pyridofluoran,
3-di(n-butyl)amino-6,8,8-trimethyl-8,9-dihydro-(3,2-e)pyridofluoran,
3'-phenyl-7-N-diethylamino-2,2'-spirodi(2H-1-benzopyran),
bis(p-dimethylaminostyryl)-p-trisulfonylmethane and
3,7-bis(dimethylamino)-10-benzoylphenothiazine. One of these dye precursors or a combination of two or more of them may be used as needed.

The total amount of the dye precursors is preferably 1 to 20% by mass relative to the total solid content of the heat-sensitive recording layer, which ensures a sufficient level of thermal responsiveness.

The mass ratio of the phenylureido developer and the dye precursor used in the present invention (phenylureido developer:dye precursor) is preferably 0.01:1 to 5:1. More preferred is 0.03:1 to 4:1.

In the thermal recording material of the present invention, the phenylureido developer can be used in combination with one or more other developers. The developer that can be used in combination with the phenylureido developer is not particularly limited, and developers generally used in pressure-sensitive recording materials and thermal recording materials can be used.

Examples of the developer that can be used in combination with the phenylureido developer include 4,4'-dihydroxydiphenylsulfone,
2,4'-dihydroxydiphenylsulfone,
4-hydroxy-4'-propoxydiphenylsulfone,
4-hydroxy-4'-isopropoxydiphenylsulfone,
4-hydroxy-4'-allyloxydiphenylsulfone,
4-hydroxy-4'-octyloxydiphenylsulfone,
4-hydroxy-4'-dodecyloxydiphenylsulfone,
4-hydroxy-4'-benzyloxydiphenylsulfone,
bis(3-allyl-4-hydroxyphenyl)sulfone,
3,4-dihydroxy-4'-methyldiphenylsulfone,
4-hydroxy-4'-benzenesulfonyloxydiphenylsulfone,
2,4-bis(phenylsulfonyl)phenol, p-phenylphenol,
p-hydroxyacetophenone, 1,1-bis(p-hydroxyphenyl)propane,
1,1-bis(p-hydroxyphenyl)pentane,
1,1-bis(p-hydroxyphenyl)hexane,
1,1-bis(p-hydroxyphenyl)cyclohexane,
2,2-bis(p-hydroxyphenyl)propane,
2,2-bis(p-hydroxyphenyl)hexane,
1,1-bis(p-hydroxyphenyl)-2-ethylhexane,
2,2-bis(3-chloro-4-hydroxyphenyl)propane,
1,1-bis(p-hydroxyphenyl)-1-phenylethane,
1,3-bis[2-(p-hydroxyphenyl)-2-propyl]benzene,
1,3-bis[2-(3,4-dihydroxyphenyl)-2-propyl]benzene,
1,4-bis[2-(p-hydroxyphenyl)-2-propyl]benzene,
4,4'-dihydroxydiphenylether,
3,3'-dichloro-4,4'-dihydroxydiphenylsulfide, methyl
2,2-bis(4-hydroxyphenyl)acetate, butyl
2, 2-bis(4-hydroxyphenyl)acetate,
4,4'-thiobis(2-tert-butyl-5-methylphenol), dimethyl
4-hydroxyphthalate, benzyl 4-hydroxybenzoate, methyl
4-hydroxybenzoate, benzyl gallate, stearyl allate, salicylanilide, 5-chlorosalicylanilide, salicylic acid,
3,5-di-tert-butylsalicylic acid,
3,5-bis(a-methylbenzyl)salicylic acid,
4-[2'-(4-methoxyphenoxy)ethyloxy]salicylic acid,
3-(octyloxycarbonylamino)salicylic acid or metal salts of these salicylic acid derivatives,
N-(4-hydroxyphenyl)-p-toluenesulfonamide,
N-(4-hydroxyphenyl)benzenesulfonamide,
N-(4-hydroxyphenyl)-1-naphthalenesulfonamide,
N-(4-hydroxyphenyl)-2-naphthalenesulfonamide,
N-(4-hydroxynaphthyl)-p-toluenesulfonamide,
N-(4-hydroxynaphthyl)benzenesulfonamide,
N-(4-hydroxynaphthyl)-1-naphthalenesulfonamide,
N-(4-hydroxynaphthyl)-2-naphthalenesulfonamide,
N-(3-hydroxyphenyl)-p-toluenesulfonamide,
N-(3-hydroxyphenyl)benzenesulfonamide,
N-(3-hydroxyphenyl)-1-naphthalenesulfonamide and
N-(3-hydroxyphenyl)-2-naphthalenesulfonamide. One of these developers or a combination of two or more of them may be used as needed. In the case where the phenylureido developer and one or more other developers listed above are used in combination, the percentage of the phenylureido developer relative to the total solid content of all the developers is preferably 50% by mass or more, and more preferably 75% by mass or more.

In the heat-sensitive recording layer of the present invention, low-melting heat-fusible substances that promote a color forming reaction (hereinafter referred to as a sensitizer) can be used for further improvement of thermal responsiveness. For this purpose, preferable sensitizers are compounds having a melting point of 60 to 180° C.

Examples of the sensitizer include fatty acid monoamides such as palmitic acid monoamide and stearic acid monoamide, diphenylsulfone, N-hydroxymethyl stearamide, N-stearyl stearamide, ethylenebis (stearamide), methylenebis (stearamide), methylol stearamide, N-stearyl urea, benzyl-2-naphthyl ether, p-toluenesulfonamide, m-terphenyl, 4-benzylbiphenyl, 2,2'-bis(4-methoxyphenoxy)diethyl ether, α,α'-diphenoxy-o-xylene, bis(4-methoxyphenyl) ether, diphenyl adipate, dibenzyl oxalate, bis(4-methylbenzyl) oxalate, bis(4-chlorobenzyl) oxalate, dimethyl terephthalate, dibenzyl terephthalate, phenyl benzenesulfonate, bis(4-allyloxyphenyl) sulfone, 1,2-bis(3-methylphenoxy)ethane, 1,2-diphenoxyethane, 4-acetylacetophenone, acetoacetanilides and fatty acid anilides. One of these sensitizers or a combination of two or more of them may be used as needed. The total amount of the sensitizers is preferably 5 to 50% by mass relative to the total solid content of the heat-sensitive recording layer, which ensures a sufficient level of thermal responsiveness.

The thermal recording material of the present invention ensures a practically sufficient level of image stability, but for a higher level of image stability, hindered phenol compounds, hindered amine compounds, phosphate ester derivatives, benzotriazole derivatives, etc. may be used as an additional component as needed in the heat-sensitive recording layer. The total amount of the hindered phenol compound, the hindered amine compound, the phosphate ester derivative and the benzotriazole derivative used as needed in the heat-sensitive recording layer is preferably 5 to 100% by mass, and more preferably 10 to 80% by mass relative to the amount of the dye precursor.

In the present invention, various kinds of pigments can be used in the heat-sensitive recording layer for purposes including the improvement of anti-sticking property, whiteness, etc., and the pigment to be used is selected as appropriate for the desired purpose. Examples of the pigment include known pigments including white inorganic pigments such as diatomite, talc, kaolin, calcined kaolin, calcium carbonate, magnesium carbonate, aluminum hydroxide, magnesium hydroxide, titanium dioxide, zinc oxide, silicon dioxide, amorphous silica, amorphous calcium silicate, colloidal silica, colloidal alumina, calcium sulfate, barium sulfate, zinc sulfide, zinc carbonate, satin white, aluminum silicate, calcium silicate, magnesium silicate, alumina, lithopone, zeolite and hydrated halloysite. Considering that basic pigments such as calcium hydroxide may deteriorate image stability against moisture and heat, the resistance to background fogging under moisture and heat, and the retention of color developing ability, the basic pigment content is preferably limited to 20% by mass or less relative to the total solid content of the pigments contained in the heat-sensitive recording layer.

The heat-sensitive recording layer of the thermal recording material of the present invention can contain a binder, and various water-soluble or water-dispersible high-molecular compounds used for conventional coating can be used as the binder. Examples of the binder include water-soluble high-molecular compounds such as starch, cellulose derivatives (e.g., hydroxymethyl cellulose, hydroxypropyl cellulose, methyl cellulose, ethyl cellulose, carboxymethyl cellulose, etc.), proteins (e.g., gelatin, casein, etc.), fully-saponified polyvinyl alcohol, partially-saponified polyvinyl alcohol, modified polyvinyl alcohol, sodium alginate, polyvinyl pyrrolidone, polyacrylamide, an acrylamide/acrylic acid ester copolymer, an acrylamide/acrylic acid ester/methacrylic acid terpolymer, an alkali salt of polyacrylic acid, an alkali salt of polymaleic acid, an alkali salt of a styrene/maleic anhydride copolymer, an alkali salt of an ethylene/maleic anhydride copolymer and an alkali salt of an isobutylene/maleic anhydride copolymer; and water-dispersible high-molecular compounds such as a styrene/butadiene copolymer, an acrylonitrile/butadiene copolymer, a methyl acrylate/butadiene copolymer, an acrylonitrile/butadiene/styrene terpolymer, polyvinyl acetate, a vinyl acetate/acrylic acid ester copolymer, an ethylene/vinyl acetate copolymer, polyacrylic acid ester, a styrene/acrylic acid ester copolymer and polyurethane. One of these compounds or two or more of them may be used as needed. The amount of the binder used is preferably 5 to 20% by mass relative to the total solid content of the heat-sensitive recording layer. In this embodiment, a thermal recording material which is excellent in the retention of color developing ability can be obtained.

In the heat-sensitive recording layer, higher fatty acid metal salts such as zinc stearate and calcium stearate, and waxes such as paraffin, oxidized paraffin, polyethylene, oxidized polyethylene and caster wax can be used as an additional component for the improvement of anti-sticking property. In addition, various kinds of hardeners and crosslinking agents can also be used as an additional component in the heat-sensitive recording layer to ensure the water resistance. Moreover, dispersants such as sodium dioctyl sulfosuccinate, surfactants, fluorescent dyes, coloring dyes, bluing agents, etc. can also be used as an additional component in the heat-sensitive recording layer.

The above-mentioned various components needed for color formation to be contained in the heat-sensitive recording layer of the thermal recording material of the present invention are dispersed in a dispersion medium, and the resulting dispersion is applied onto the paper support or the undercoat layer, and then dried. The dispersion can be prepared, for example, by dry grinding the component compounds needed for color formation, and dispersing the dry ground compounds in a dispersion medium, or by wet grinding, in a dispersion medium, the component compounds needed for color formation. In a preferable embodiment of the present invention, the phenylureido developer, one or more other developers used in combination with the phenylureido developer and the sensitizer are separately or together ground, if needed in the presence of a dispersant, in water as a dispersion medium using a wet grinding mill such as a sand grinder, a ball mill, an attritor and a bead mill until fine particles, preferably fine particles having a volume-average particle diameter of 0.1 to 5.0 μm, are obtained, and the resulting fine particle-containing dispersion(s) is/are used for the preparation of a coating liquid for heat-sensitive recording layer formation. In a preferable embodiment of the present invention, the dye precursor is ground separately from the developers, if needed in the presence of a dispersant, in water as a dispersion medium using a wet grinding mill such as a sand grinder, a ball mill, an attritor and a bead mill until fine particles, preferably fine particles having a volume-average particle diameter of 0.1 to 5.0 μm, are obtained, and the resulting fine particle-containing dispersion is used for the preparation of a coating liquid for heat-sensitive recording layer formation.

Examples of the dispersant used if needed for the dispersion of the component compounds needed for color formation to be contained in the heat-sensitive recording layer in the present invention include water-soluble high-molecular compounds such as polyvinyl alcohols (e.g., fully-saponified polyvinyl alcohol, partially-saponified polyvinyl alcohol, sulfonic acid-modified polyvinyl alcohol, silanol-modified polyvinyl alcohol, carboxyl-modified polyvinyl alcohol, diacetone-modified polyvinyl alcohol, acetoacetyl-modified polyvinyl alcohol, phosphoric acid-modified polyvinyl alcohol, butyral-modified polyvinyl alcohol, epoxy-modified polyvinyl alcohol, etc.), starch or its derivatives, cellulose derivatives (e.g., hydroxyethyl cellulose, methyl cellulose, hydroxypropyl cellulose, ethyl cellulose, carboxymethyl cellulose, etc.), proteins (e.g., gelatin, casein, etc.), acid neutralizers for chitosan, sodium alginate, polyvinyl pyrrolidone, salts of a diisobutylene/maleic anhydride copolymer, salts of a styrene/isobutylene/maleic anhydride copolymer, salts of a styrene/maleic anhydride copolymer, salts of an ethylene/acrylic acid copolymer, salts of a styrene/acrylic acid copolymer, polyacrylates and polyacrylic sulfonates; low-molecular anionic surfactants such as dodecylbenzene sulfonates, dialkyl sulfosuccinates, alkylnaphthalene sulfonates, alkyl diphenyl ether disulfonates and fatty acid metal salts; and nonionic surfactants such as acetylene glycol. One of these compounds or two or more of them may be used as needed. The amount of the dispersant used is preferably 0.5 to 30% by mass relative to the total amount of the components needed for color formation. For the dispersion of the phenylureido developer, sulfonic acid-modified polyvinyl alcohol or carboxyl-modified polyvinyl alcohol is particularly preferably used. In this embodiment, a higher level of the resistance to background fogging under moisture and heat can be achieved.

In addition, when the phenylureido developer and other components needed for color formation to be contained in the heat-sensitive recording layer of the thermal recording material of the present invention are around, they may be ground in the presence of an inorganic pigment such as magnesium silicate, calcium silicate, magnesium carbonate, calcium carbonate, calcium sulfate, magnesium phosphate, magnesium oxide, aluminum oxide, titanium oxide, magnesium hydroxide, kaolin, talc and hydrotalcite so that the resistance to background fogging under moisture and heat can be achieved. After grinding, the dispersions containing the components needed for color formation may be heated at a temperature of 40 to 80° C.

In the present invention, a protective layer can be provided on the heat-sensitive recording layer for purposes including the improvement of anti-sticking property, the prevention of scratching, the enhancement of water resistance and the enhancement of the plasticizer and chemical resistance of thermally developed images. The protective layer can contain various kinds of adhesives, inorganic pigments, various kinds of curing agents, various kinds of crosslinking agents, ultraviolet absorbers, etc. The protective layer may be a monolayer, or be composed of two or more layers. In addition, on the surface of the heat-sensitive recording layer or the protective layer, printing with a UV ink or the like may be made, for example.

According to the present invention, the thermal recording material preferably has a backcoat layer containing a hydrophobic resin on the opposite side of the paper support from the heat-sensitive recording layer because such a backcoat layer can enhance the retention of color developing ability.

Examples of the hydrophobic resin contained in the backcoat layer in the present invention include emulsions of polyvinyl acetate, polyurethane, polyacrylic acid ester, a vinyl chloride/vinyl acetate copolymer, polybutyl methacrylate, an ethylene/vinyl acetate copolymer, a styrene/butadiene copolymer, a styrene/butadiene/acrylic copolymer, etc.; and latices of a copolymer composed of acrylonitrile, methacrylamide, styrene, acrylates (e.g., ethyl acrylate, butyl acrylate, diethylene glycol acrylate, 2-ethyl hexyl acrylate, etc.), methacrylates (e.g., allyl methacrylate, methyl methacrylate, ethyl methacrylate, butyl methacrylate, etc.), methacrylic acid, etc. The resin particles in the latex may have a core-shell structure etc. One of these compounds or two or more of them may be used as needed. The amount of to the hydrophobic resin used is preferably 30 to 100% by mass relative to the total solid content of the backcoat layer. In this embodiment, a thermal recording material which is excellent in the retention of color developing ability can be obtained.

According to the present invention, the backcoat layer can contain, in addition to the hydrophobic resin, various kinds of binders, inorganic pigments, organic pigments, various kinds of curing agents, various kinds of crosslinking agents, ultraviolet absorbers, etc. The backcoat layer may be a monolayer, or composed of two or more layers. On the backcoat layer of the present invention, an anti-curl layer, an antistatic layer and/or other functional layers may be provided. The surface of the backcoat layer may have been subjected to adhesive processing etc.

According to the present invention, the coating weight of the heat-sensitive recording layer is preferably 2 to 15 g/m$^2$ on a solid basis. When the coating weight is less than 2 g/m$^2$, the color developing ability under the application of low-level thermal energy and the color developing ability after storage under hot and humid conditions may be reduced. When the coating weight is more than 15 g/m$^2$, the improvement of various functions which the heat-sensitive recording layer is supposed to have stays at a maximum level, but the production efficiency in the coating for the formation of the heat-sensitive recording layer may be reduced. The coating weight of the protective layer is preferably 0.5 to 5 g/m$^2$ on a solid basis. When the coating weight is less than 0.5 g/m$^2$, various functions which the protective layer is supposed to have cannot be attained. When the coating weight is more than 5 g/m$^2$, the loss in thermal energy transmitted from a thermal head to the heat-sensitive recording layer is greater, which may result in deterioration in color developing ability. The coating weight of the backcoat layer is preferably 0.5 to 15 g/m$^2$ on a solid basis. When the coating weight is less than 0.5 g/m$^2$, the effect of enhancing the retention of color developing ability may not be sufficiently achieved. When the coating weight is more than 15 g/m$^2$, the effect of enhancing retention of color developing ability stays at a maximum level, but the production efficiency in the coating for the formation of the backcoat layer may be reduced.

According to the present invention, on the heat-sensitive recording layer side or on the opposite side from the heat-sensitive recording layer, a layer containing an electrical, magnetic or optical data recording component, an inkjet recording layer, etc. may be provided. In addition, any layer of the thermal recording material and the paper support can contain a photothermal component for laser printing.

For the formation of the layers in the present invention, well-known techniques can be used without any particular limitation. For example, coating machines such as air knife coaters, various kinds of blade coaters, various kinds of bar coaters and various kinds of curtain coaters; and various printing processes such as lithographic printing, letterpress printing, intaglio printing, flexographic printing, gravure printing and screen printing can be used. For the improvement of surface smoothness, a machine calender, a super calender, a gloss calender, brushing and other devices may be used, and various known techniques employed in the production of thermal recording materials may be used.

EXAMPLES

Hereinafter, the present invention will be illustrated by examples, but present invention is not limited thereto. Various alterations and modifications can be made without departing from the technical scope of the present invention. In the following Examples, "percentage (%)" and "part" are each on a mass basis unless otherwise specified.

Example 1

(1) Production of Polyacrylamides

Into a one-liter four-necked flask equipped with a stirrer, a thermometer, a reflux condenser and a nitrogen gas inlet tube, 684.4 g of water, 248.2 g of a 50% aqueous acrylamide solution (acrylamide), 25.54 g of a 80% aqueous solution of N-benzyl-N,N-dimethyl-(2-methacryloyloxyethyl) ammonium chloride (cationic monomer), 4.68 g of itaconic acid (anionic monomer) and 12.95 g of a 2% aqueous solution of sodium hypophosphite (chain transfer agent) were placed. To this, 4.11 g of a 5% aqueous solution ammonium persulfate (radical polymerization initiator) was added, the mixture was heated to 80° C. in nitrogen gas flow, and a polymerization reaction was allowed to proceed until completion. The resultant was named polyacrylamide A-1. The thus-obtained polyacrylamide A-1 had a nonvolatile content of 15% and a Brookfield viscosity of 7000 cps at 25° C. and pH 4. The monomer composition, the nonvolatile content and the viscosity are shown in Table 1.

Based on the combination ratio of the monomer components described in Table 1, a polymerization reaction was performed in the same manner as in the case of polyacrylamide A-1 to give polyacrylamide A-2 or A-3. The measured results of polyacrylamides A-2 and A-3 are also shown in Table 1 together with those of polyacrylamide A-1. The amount of the chain transfer agent used for the polymerization reaction was varied as appropriate so that the three polyacrylamides had the same level of viscosity.

TABLE 1

| Polyacrylamide | Cationic monomer (mol %) | Anionic monomer (mol %) | Acrylamides (mol %) | Nonvolatile content (%) | Viscosity (CPS) | Cationic groups/ anionic groups ratio (%) |
|---|---|---|---|---|---|---|
| A-1 | 4 | 2 | 94 | 15 | 7000 | 200 |
| A-2 | 3 | 3 | 94 | 15 | 7200 | 100 |
| A-3 | 2 | 4 | 94 | 15 | 7500 | 50 |

(2) Production of Paper Support

A blend of 80% of LBKP having a Canadian Standard Freeness (CSF) of 350 mL and 20% of an NBKP having a Canadian Standard Freeness (CSF) of 350 mL was prepared and mixed with the other components and water at the ratio described below based on the total solid content of the pulps to give a pulp slurry.

| | |
|---|---|
| Precipitated calcium carbonate | 12% |
| Neutral rosin sizing agent (manufactured by SEIKO PMC CORPORATION, CC-1404) | 0.25% |
| Aluminum sulfate | 1.5% |
| Cationic starch (manufactured by Matsutani Chemical Industry Co., Ltd., Excelbond 327) | 1% |

The prepared pulp slurry was made into a sheet of paper in a Fourdrinier paper machine. The sheet of paper was subjected to machine calendering to give a paper support having a basis weight of 50 g/m$^2$ and a Bekk smoothness of 60 seconds at both surfaces. The ash content of the obtained paper support was 10%.

(3) Preparation of Pigment Liquid for Undercoat Layer Formation

A mixture of the following components at the indicated ratio was stirred to give a pigment liquid for undercoat layer formation.

| | |
|---|---|
| Calcined kaolin | 100 parts |
| 10% Aqueous ammonium polyacrylate solution | 5 parts |
| Sodium hexametaphosphate | 0.5 part |
| Water | 199.5 parts |

(4) Preparation of Coating Liquid for Undercoat Layer Formation

A mixture of the following components at the indicated ratio was sufficiently stirred to give a coating liquid for undercoat layer formation.

| | |
|---|---|
| Pigment liquid for undercoat layer formation prepared in the above (3) | 305 parts |
| 20% Styrene-butadiene latex | 75 parts |
| 20% Aqueous solution of urea-modified phosphorylated starch | 25 parts |

(5) Formation of Undercoat Layer

The coating liquid for undercoat layer formation prepared in the above (4) was applied onto the paper support prepared in the above (2) in such an amount that the coating weight would be 10 g/m$^2$ on a solid basis, and then dried to form an undercoat layer on the paper support.

(6) Preparation of Dye Precursor Dispersion

A mixture of the following components at the indicated ratio was wet-ground in a bead mill until the volume-average particle diameter became 0.7 μm, and a dye precursor dispersion was obtained.

| | |
|---|---|
| 3-Di-n-butylamino-6-methyl-7-anilinofluorane | 12 parts |
| 10% Aqueous solution of sulfonic acid-modified polyvinyl alcohol | 12 parts |
| Water | 20 parts |

(7) Preparation of Developer Dispersion

A mixture of the following components at the indicated ratio was wet-ground in a bead mill until the volume-average particle diameter became 0.7 μM, and a developer dispersion was obtained.

| | |
|---|---|
| 4,4'-Bis[(4-methyl-3-phenoxycarbonylaminophenyl)ureido]diphenylsulfone (manufactured by Chemipro Kasei Kaisha, Ltd., UU) | 36 parts |
| 10% Aqueous solution of sulfonic acid-modified polyvinyl alcohol | 36 parts |
| Water | 60 parts |

(8) Preparation of Sensitizer Dispersion

A mixture of the following components at the indicated ratio was wet-ground in a bead mill until the volume-average particle diameter became 0.7 μm, and a sensitizer dispersion was obtained.

| | |
|---|---|
| 1,2-Bis(3-methylphenoxy)ethane | 12 parts |
| 10% Aqueous solution of sulfonic acid-modified polyvinyl alcohol | 12 parts |
| Water | 20 parts |

(9) Preparation of Pigment Dispersion

A mixture of the following components at the indicated ratio was stirred to give a pigment dispersion.

| | |
|---|---|
| Aluminum hydroxide | 16 parts |
| Amorphous silica | 16 parts |
| 10% Aqueous ammonium polyacrylate solution | 3.2 parts |
| Water | 82.5 parts |

(10) Preparation of Coating Liquid for Heat-Sensitive Recording Layer Formation

A mixture of the following components at the indicated ratio was sufficiently stirred to give a coating liquid for heat-sensitive recording layer formation.

| | |
|---|---|
| Dye precursor dispersion prepared in the above (6) | 44 parts |
| Developer dispersion prepared in the above (7) | 132 parts |
| Sensitizer dispersion prepared in the above (8) | 44 parts |
| Pigment dispersion prepared in the above (9) | 117.7 parts |
| 10% Aqueous solution of fully-saponified polyvinyl alcohol | 160 parts |
| 50% Aqueous zinc stearate dispersion | 20 parts |

(11) Production of Thermal Recording Material

The coating liquid for heat-sensitive recording layer formation prepared in the above (10) was applied onto the undercoat layer formed on the paper support as described in the above (5) in such an amount that the coating weight would be 2.5 g/m$^2$ on a solid basis, and then dried. Subsequently, calendering was performed, and the thermal recording material of Example 1 was obtained. The Bekk smoothness of the calendered thermal recording material on the side with the heat-sensitive recording layer was 350 seconds.

Example 2

The thermal recording material of Example 2 was produced in the same manner as described in Example 1, except that the amount of the neutral rosin sizing agent (manufactured by SEIKO PMC CORPORATION, CC-1404) was changed from 0.25% to 0.4% in (2) Production of Paper Support.

Example 3

The thermal recording material of Example 3 was produced in the same manner as described in Example 1, except that the amount of the neutral rosin sizing agent (manufactured by SEIKO PMC CORPORATION, CC-1404) was changed from 0.25% to 1% in (2) Production of Paper Support.

Example 4

The thermal recording material of Example 4 was produced in the same manner as described in Example 1, except that 36 parts of 3-(3-tosylureido)phenyl p-toluenesulfonate (manufactured by BASF Japan Ltd., PERGAFAST 201) was used instead of 36 parts of 4,4'-bis[(4-methyl-3-phenoxycarbonylaminophenyl)ureido]diphenylsulfone (manufactured by Chemipro Kasei Kaisha, Ltd., UU) in (7) Preparation of Developer Dispersion.

Example 5

The thermal recording material of Example 5 was produced in the same manner as described in Example 1, except that 36 parts of N-[2-(3-phenylureido)phenyl]benzenesulfonamide was used instead of 36 parts of 4,4'-bis[(4-methyl-3-phenoxycarbonylaminophenyl)ureido]diphenylsulfone (manufactured by Chemipro Kasei Kaisha, Ltd., UU) in (7) Preparation of Developer Dispersion.

Example 6

The thermal recording material of Example 6 was produced in the same manner as described in Example 1, except that 4% of precipitated calcium carbonate and 8% of talc were used instead of 12% of the precipitated calcium carbonate in (2) Production of Paper Support.

Example 7

The thermal recording material of Example 7 was obtained in the same manner as described in Example 1, except that 1% as the solids of polyacrylamide A-1, which was produced in (1) Production of Polyacrylamides, was used instead of 1% of the cationic starch (manufactured by Matsutani Chemical Industry Co., Ltd., Excelbond 327) in (2) Production of Paper Support.

Example 8

The thermal recording material of Example 8 was obtained in the same manner as described in Example 1, except that 1% as the solids of polyacrylamide A-2, which was produced in (1) Production of Polyacrylamides, was used instead of 1% of the cationic starch (manufactured by Matsutani Chemical Industry Co., Ltd., Excelbond 327) in (2) Production of Paper Support.

Example 9

The thermal recording material of Example 9 was obtained in the same manner as described in Example 1, except that 1% as the solids of polyacrylamide A-3, which was produced in (1) Production of Polyacrylamides, was used instead of 1% of the cationic starch (manufactured by Matsutani Chemical Industry Co., Ltd., Excelbond 327) in (2) Production of Paper Support.

Example 10

The thermal recording material of Example 10 was obtained in the same manner as described in Example 1, except that 1% as the solids of polyacrylamide A-2, which was produced in (1) Production of Polyacrylamides, was used instead of 1% of the cationic starch (manufactured by Matsutani Chemical Industry Co., Ltd., Excelbond 327) in (2) Production of Paper Support; and except that 36 parts of N-[2-(3-phenylureido)phenyl]benzenesulfonamide was used instead of 36 parts of 4,4'-bis[(4-methyl-3-phenoxycarbonylaminophenyl)ureido]diphenylsulfone (manufactured by Chemipro Kasei Kaisha, Ltd., UU) in (7) Preparation of Developer Dispersion.

Example 11

The following change was made in (11) Production of Thermal Recording Material in Example 1. The coating liquid for heat-sensitive recording layer formation prepared in the above (10) was applied onto the undercoat layer formed on the paper support as described in the above (5) in such an amount that the coating weight would be 2.5 g/m$^2$ on a solid basis, and then dried. Subsequently, the coating liquid for backcoat layer formation prepared in the following (12) was applied on the opposite side of the paper support from the heat-sensitive recording layer in such an amount that the coating weight would be 2.0 g/m$^2$ on a solid basis, and then dried. Finally, calendering was performed, and the thermal recording material of Example 11 was obtained. The Bekk smoothness of the calendered thermal recording material on the side with the heat-sensitive recording layer was 350 seconds.

(12) Preparation of Coating Liquid for Backcoat Layer Formation

A mixture of the following components at the indicated ratio was sufficiently stirred to give a coating liquid for backcoat layer formation.

| | |
|---|---|
| Hydrophobic resin: 20% acrylic emulsion (manufactured by Mitsui Chemicals, Inc., OM-1050) | 100 parts |
| Water | 100 parts |

Example 12

The thermal recording material of Example 12 was produced in the same manner as described in Example 11, except that 100 parts of a 20% styrene/butadiene copolymer emulsion (an aqueous dilution of Nipol LX407K manufactured by Zeon Corporation) was used instead of 100 parts of the 20% acrylic emulsion (manufactured by Mitsui Chemicals, Inc., OM-1050) as the hydrophobic resin in (12) Preparation of Coating Liquid for Backcoat layer Formation Example 13

The thermal recording material of Example 13 was produced in the same manner as described in Example 11, except that the coating liquid for backcoat layer formation prepared in the following (13) was used instead of the coating liquid for backcoat layer formation prepared in the above (12).

(13) Preparation of Coating Liquid for Backcoat Layer Formation

A mixture of the following components at the indicated ratio was sufficiently stirred to give a coating liquid for backcoat layer formation.

| | |
|---|---|
| Hydrophobic resin: 20% styrene/butadiene copolymer emulsion (an aqueous dilution of Nipol LX407K manufactured by Zeon Corporation) | 100 parts |
| 20% Aqueous phosphorylated starch solution (Manufactured by NIHON SHOKUHIN KAKO CO., LTD., MS4600) | 50 parts |
| Water | 150 parts |

Comparative Example 1

The thermal recording material of Comparative Example 1 was produced in the same manner as described in Example 1, except that the amount of the neutral rosin sizing agent (manufactured by SEIKO PMC CORPORATION, CC-1404) was changed from 0.25% to 0.2% in (2) Production of Paper Support.

Comparative Example 2

The thermal recording material of Comparative Example 2 was produced in the same manner as described in Example 1, except that 0.25% of an alkyl ketene dimer-based sizing agent (manufactured by Arakawa Chemical Industries, Ltd., Sizepine K903) was used instead of 0.25% of the neutral rosin sizing agent (manufactured by SEIKO PMC CORPORATION, CC-1404) in (2) Production of Paper Support.

Comparative Example 3

The thermal recording material of Comparative Example 3 was produced in the same manner as described in Example 1, except that 0.25% of an alkenyl succinic anhydride-based sizing agent (manufactured by SEIKO PMC CORPORATION, AS-1540) was used instead of 0.25% of the neutral rosin sizing agent (manufactured by SEIKO PMC CORPORATION, CC-1404) in (2) Production of Paper Support.

Comparative Example 4

The thermal recording material of Comparative Example 4 was produced in the same manner as described in Example 1, except that 0.25% of a higher fatty acid-based sizing agent (manufactured by Arakawa Chemical Industries, Ltd., Sizepine AM) was used instead of 0.25% of the neutral rosin sizing agent (manufactured by SEIKO PMC CORPORATION, CC-1404) in (2) Production of Paper Support.

Comparative Example 5

The thermal recording material of Comparative Example 5 was produced in the same manner as described in Example 1, except that the following change was made in the preparation of a pulp slurry in (2) Production of Paper Support.

A blend of 80% of LBKP having a Canadian Standard Freeness (CSF) of 350 mL and 20% of an NBKP having a Canadian Standard Freeness (CSF) of 350 mL was prepared and mixed with the other components and water at the ratio described below based on the total pulp content to give a pulp slurry.

| | |
|---|---|
| Precipitated calcium carbonate | 12% |
| Neutral rosin sizing agent (manufactured by SEIKO PMC CORPORATION, CC-1404) | 0.25% |

-continued

| | |
|---|---|
| Cationic starch (manufactured by Matsutani Chemical Industry Co., Ltd., Excelbond 327) | 1% |

Comparative Example 6

The thermal recording material of Comparative Example 6 was produced in the same manner as described in Example 1, except that 12% of calcium hydroxide was used instead of 12% of the precipitated calcium carbonate in (2) Production of Paper Support.

Comparative Example 7

The thermal recording material of Comparative Example 7 was produced in the same manner as described in Example 1, except that the following change was made in the preparation of a pulp slurry in (2) Production of Paper Support.

A blend of 80% of LBKP having a Canadian Standard Freeness (CSF) of 350 mL and 20% of an NBKP having a Canadian Standard Freeness (CSF) of 350 mL was prepared and mixed with the other components and water at the ratio described below based on the total solid content of the pulps to give a pulp slurry.

| | |
|---|---|
| Talc | 12% |
| Acidic rosin sizing agent (manufactured by SEIKO PMC CORPORATION, AL-120) | 0.8% |
| Aluminum sulfate | 2.5% |
| Polyacrylamide A-3 (solids) | 1% |

Comparative Example 8

The thermal recording material of Comparative Example 8 was produced in the same manner as described in Example 1, except that 36 parts of 4,4'-isopropylidenediphenol was used instead of 36 parts of 4,4'-bis[(4-methyl-3-phenoxycarbonylaminophenyl)ureido]diphenylsulfone (manufactured by Chemipro Kasei Kaisha, Ltd., UU) in (7) Preparation of Developer Dispersion.

Comparative Example 9

The thermal recording material of Comparative Example 9 was produced in the same manner as described in Example 1, except that 36 parts of 2,4'-dihydroxydiphenylsulfone was used instead of 36 parts of 4,4'-bis[(4-methyl-3-phenoxycarbonylaminophenyl)ureido]diphenylsulfone (manufactured by Chemipro Kasei Kaisha, Ltd., UU) in (7) Preparation of Developer Dispersion.

Comparative Example 10

The thermal recording material of Comparative Example 10 was produced in the same manner as described in Example 1, except that the amount of the neutral rosin sizing agent (manufactured by SEIKO PMC CORPORATION, CC-1404) was changed from 0.25% to 1.5% in (2) Production of Paper Support.

The thermal recording materials produced in Examples 1 to 13 and Comparative Examples 1 to 10 were subjected to the evaluations shown below. The evaluation results of these materials are shown in Table 2.

<Plasticizer Resistance>

On each of the produced thermal recording materials, black solid printing was performed with an applied energy of 0.50 mJ/dot using the facsimile tester TH-PMD manufactured by Okura. Engineering Co., LTD. in an environment at 23° C. and 50% relative humidity. For plasticizer treatment, the printed surface of each thermal recording material was brought into close contact with a sheet of the vi chloride wrapping film Hi-Wrap SAS-300 manufactured by Mitsui Chemicals Fabro, Inc., and kept in an environment at 23° C. and 50% relative humidity for 24 hours. After removal of the sheet of Hi-Wrap SAS-300, the optical density of the printed area was measured with a densitometer (manufactured by GretagMacbeth, RD19) (black mode) in an environment at 23° C. and 50% relative humidity, and evaluated according to the following criteria.

Retention percentage (%)=(optical density of plasticizer-treated material)/(optical density of non-treated material)×100

A: The retention percentage was 75% or more.
B: The retention percentage was 65% or more but less than 75%.
C: The retention percentage was less than 65%.

<Image Stability against Moisture and Heat>

On each of the produced thermal recording materials, black solid printing was performed with an applied energy of 0.50 mJ/dot using the facsimile tester TH-PMD manufactured by Okura Engineering Co., LTD. in an environment at 23° C. and 50% relative humidity. For moisture and heat treatment, each thermal recording material which had been subjected to printing was kept in an environment at 50° C. and 90% relative humidity for 24 hours. After that, the optical density of the printed area was measured with a densitometer (manufactured by GretagMacbet, RD19) (black mode) in an environment at 23° C. and 50% relative humidity, and evaluated according to the following criteria.

Retention percentage (%)=(optical density of moisture-and-heat-treated material)/(optical density of non-treated material)×100

A: The retention percentage was 95% or more.
B: The retention percentage was 90% or more but less than 95%.
C: The retention percentage was less than 90%.

<Resistance to Background Fogging under Moisture and Heat>

For moisture and heat treatment, each of the produced thermal recording materials was kept in an environment at 50° C. and 90% relative humidity for 24 hours. After that, the optical density of the unprinted surface of the heat-sensitive recording layer was measured with a densitometer (manufactured by GretagMacbeth, RD19) (black mode) in an environment at 23° C. and 50% relative humidity, and evaluated according to following criteria.

Discoloration value (%)=(optical density of moisture-and-heat-treated material)/(optical density of non-treated material)×100

A: The discoloration value was less than 110%.
B: The discoloration value was 110% or more but less than 150%.
C: The discoloration value was 150% or more.

<Retention of Color Developing Ability>

For moisture and heat treatment, each of the produced thermal recording materials was kept in an environment at 50° C. and 90% relative humidity for 24 hours. After the moisture and heat treatment, black solid printing was performed thereon with an applied energy of 0.50 mJ/dot using the facsimile tester TH-PMD manufactured by Okura Engineering Co., LTD. in an environment at 23° C. and 50% relative humidity. After that, the optical density of the printed area was measured with a densitometer (manufactured by GretagMacbeth, RD19) (black mode) in an environment at 23° C. and 50% relative humidity, and evaluated according to the following criteria.

Percentage of retention of color developing ability (%)=(optical density of moisture-and-heat-treated material)/(optical density of non-treated material)×100

A: The percentage of the retention of color developing ability was 97% or more.
B: The percentage of the retention of color developing ability was 95% or more but less than 97%.
C: The percentage of the retention of color developing ability was less than 95%.

TABLE 2

| | | | | |
|---|---|---|---|---|
| Example 1 | A | A | B | B |
| Example 2 | A | A | B | A |
| Example 3 | A | A | B | A |
| Example 4 | B | A | B | A |
| Example 5 | A | A | A | A |
| Example 6 | A | A | B | A |
| Example 7 | A | A | B | A |
| Example 8 | A | A | B | A |
| Example 9 | A | A | B | A |
| Example 10 | A | A | A | A |
| Example 11 | A | A | B | A |
| Example 12 | A | A | B | A |
| Example 13 | A | A | B | A |
| Comparative Example 1 | A | A | B | C |
| Comparative Example 2 | A | A | B | C |
| Comparative Example 3 | A | A | B | C |
| Comparative Example 4 | A | A | B | C |
| Comparative Example 5 | A | B | B | C |
| Comparative Example 6 | A | B | C | C |
| Comparative Example 7 | A | A | C | A |
| Comparative Example 8 | C | C | B | C |
| Comparative Example 9 | C | C | A | C |
| Comparative Example 10 | A | A | B | C |

As is clear from Table 2, thermal recording materials which were excellent in plasticizer resistance, image stability against moisture and heat, the resistance to background fogging under moisture and heat, and the retention of color developing ability were obtained according to the present invention. It was also revealed that the thermal recording material of Example 10 was more excellent in paper strength (breaking length: JIS P 8113:1998 and Clark stiffness: JIS P 8143:1996) of the paper support than the thermal recording material of Example 5.

The thermal recording material of Comparative Example 1 had a smaller amount of the neutral rosin sizing agent in the paper support than the lower limit specified in the present invention. The thermal recording materials of Comparative Examples 2, 3 and 4 contained no neutral rosin sizing agent in the paper support. The thermal recording material of Comparative Example 5 did not contain aluminum sulfate in the paper support. The thermal recording materials of Comparative Examples 6 and 7 did not contain calcium carbonate in the paper support. The thermal recording materials of Comparative Examples 8 and 9 contained no phenylureido developer in the heat-sensitive recording layer. The thermal recording material of Comparative Example 10 had a larger amount of the neutral rosin sizing agent in the paper support than the upper limit specified in the present invention. For the reasons mentioned above, the thermal recording materials of Comparative Examples 1 to 10 were inferior in at least one of the four characteristic values: plasticizer resistance, image stability against moisture and heat, the resistance to background fogging under moisture and heat, and the retention of color developing ability (evaluated as "C" regarding at least one of the four characteristic values).

The invention claimed is:

1. A thermal recording material having, on a paper support, a heat-sensitive recording layer containing a colorless or light-colored dye precursor and a developer which reacts with the dye precursor on heating and converts the dye precursor to its colored form, the paper support containing 0.25 to 1.0% by mass of a neutral rosin sizing agent relative to the pulp solid content in combination with calcium carbonate and aluminum sulfate, the developer having a phenylureido moiety in its molecule.

2. The thermal recording material according to claim 1, wherein the phenylureido moiety is represented by the following general formula (1):

General formula (1)

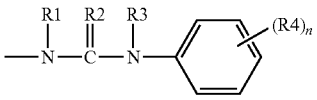

(wherein R1 and R3 are hydrogen atoms, R2 is an oxygen atom, R4 is selected from a hydrogen atom and a group that can be a substituent on the benzene ring, and n is an integer of 1 to 5).

3. The thermal recording material according to claim 2, wherein the paper support further contains polyacrylamide.

4. The thermal recording material according to claim 3, wherein the polyacrylamide is an amphoteric polyacrylamide in which the ratio of cationic groups to anionic groups is 50 to 200%.

5. The thermal recording material according to claim 1, wherein the developer is a compound represented by the following general formula (2):

General formula (2)

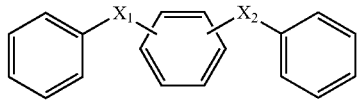

(wherein $X_1$ is —NHCONH—, $X_2$ is —$NHSO_2$—, and each of the three benzene rings may have a substituent(s)).

6. The thermal recording material according to claim 5, wherein the developer is N-[2-(3-phenylureido)phenyl]benzenesulfonamide.

7. The thermal recording material according to claim 6, wherein the paper support further contains polyacrylamide.

8. The thermal recording material according to claim 7, wherein the polyacrylamide is an amphoteric polyacrylamide in which the ratio of cationic groups to anionic groups is 50 to 200%.

9. The thermal recording material according to claim 5, wherein the paper support further contains polyacrylamide.

10. The thermal recording material according to claim 9, wherein the polyacrylamide is an amphoteric polyacrylamide in which the ratio of cationic groups to anionic groups is 50 to 200%.

11. The thermal recording material according to claim 1 wherein the paper support further contains polyacrylamide.

12. The thermal recording material according to claim 11, wherein the polyacrylamide is an amphoteric polyacrylamide in which the ratio of cationic groups to anionic groups is 50 to 200%.

13. The thermal recording material according to claim 1, wherein a backcoat layer containing a hydrophobic resin is provided on the opposite side of the paper support from the heat-sensitive recording layer.

* * * * *